US010456804B2

(12) United States Patent
Tanner

(10) Patent No.: US 10,456,804 B2
(45) Date of Patent: Oct. 29, 2019

(54) APPLICATION DEVICE

(71) Applicant: SIKA TECHNOLOGY AG, Baar (CH)

(72) Inventor: Pascal Tanner, Schmerikon (CH)

(73) Assignee: SIKA TECHNOLOGY AG, Baar (CH)

( * ) Notice: Subject to any disclaimer, the term of this patent is extended or adjusted under 35 U.S.C. 154(b) by 0 days.

(21) Appl. No.: 15/513,372

(22) PCT Filed: Sep. 18, 2015

(86) PCT No.: PCT/EP2015/071510
§ 371 (c)(1),
(2) Date: Mar. 22, 2017

(87) PCT Pub. No.: WO2016/046097
PCT Pub. Date: Mar. 31, 2016

(65) Prior Publication Data

US 2017/0304865 A1 Oct. 26, 2017

(30) Foreign Application Priority Data

Sep. 23, 2014 (EP) ..... 14186036

(51) Int. Cl.
*B05C 17/01* (2006.01)
*B05C 17/005* (2006.01)
(Continued)

(52) U.S. Cl.
CPC .... *B05C 17/00566* (2013.01); *B01F 7/00675* (2013.01); *B01F 13/0027* (2013.01);
(Continued)

(58) Field of Classification Search
CPC ..... B05C 17/00566; B05C 17/01; B05C 17/00553; B01F 7/00675; B01F 13/0027;
(Continued)

(56) References Cited

U.S. PATENT DOCUMENTS 6,457,609 B1 10/2002 Keller
6,854,621 B2 * 2/2005 Keller ..... B05C 17/00509 222/137
(Continued)

FOREIGN PATENT DOCUMENTS

CN 104010735 A 8/2014
DE 32 37 353 A1 4/1984
(Continued)

OTHER PUBLICATIONS

International Preliminary Report on Patentability (Form PCT/IB/338) and the Written Opinion of the International Searching Authority (Form PCT/ISA/237) dated Apr. 6, 2017, by the International Bureau of WIPO, in corresponding International Application No. PCT/EP2015/071510. (10 pages).
(Continued)

*Primary Examiner* — Frederick C Nicolas
(74) *Attorney, Agent, or Firm* — Oliff PLC

(57) ABSTRACT

The disclosure relates to an application device for multi-component substances, in particular multi-component adhesives or multi-component sealants, including: at least two cartridge receiving devices for receiving replaceable cartridges with substance components that are to be mixed; a discharging device for discharging the substance components from the cartridges; a mixing device for mixing the substance components, wherein the mixing device includes a rotary mixer which is driven via a drive shaft, the drive shaft having at least one flexible portion with a first end and a second end.

19 Claims, 2 Drawing Sheets

(51) Int. Cl.

| | |
|---|---|
| ***B01F 13/00*** | (2006.01) |
| ***B01F 15/00*** | (2006.01) |
| ***B01F 7/00*** | (2006.01) |
| ***B05B 9/08*** | (2006.01) |

(52) U.S. Cl.
CPC ..... *B01F 15/0087* (2013.01); *B05B 9/0805* (2013.01); *B05C 17/00553* (2013.01); *B05C 17/01* (2013.01); *B01F 2215/0039* (2013.01)

(58) Field of Classification Search
CPC ..... B01F 15/0087; B01F 2215/0039; B05B 9/0805
See application file for complete search history.

(56) References Cited

U.S. PATENT DOCUMENTS

| | | | |
|---|---|---|---|
| 2002/0190082 | A1 | 12/2002 | Keller |
| 2013/0277390 | A1* | 10/2013 | Buck ..... B05C 17/00553 222/80 |
| 2014/0301156 | A1 | 10/2014 | Rahm et al. |
| 2014/0346190 | A1 | 11/2014 | Buck |
| 2014/0346251 | A1 | 11/2014 | Schultheiss |

FOREIGN PATENT DOCUMENTS

| | | | |
|---|---|---|---|
| EP | 0603492 | A1 | 6/1994 |
| EP | 1 072 323 | A1 | 1/2001 |
| EP | 2230021 | A1 | 9/2010 |
| EP | 2 468 415 | A1 | 6/2012 |
| EP | 2 606 986 | A1 | 6/2013 |
| EP | 2 608 984 | A1 | 6/2013 |
| EP | 2 608 985 | A1 | 6/2013 |

OTHER PUBLICATIONS

International Search Report (PCT/ISA/210) dated Nov. 17, 2015, by the European Patent Office as the International Searching Authority for International Application No. PCT/EP2015/071510.

Written Opinion (PCT/ISA/237) dated Nov. 17, 2015, by the European Patent Office as the International Searching Authority for International Application No. PCT/EP2015/071510.

International Search Report (PCT/ISA/210) dated Nov. 17, 2015, by the European Patent Office as the International Searching Authority for International Application No. PCT/EP2015/071506.

Written Opinion (PCT/ISA/237) dated Nov. 17, 2015, by the European Patent Office as the International Searching Authority for International Application No. PCT/EP2015/071506.

Oct. 15, 2018 Office Action issued in European Patent Application No. 15763636.6.

Dec. 5, 2018 Office Action issued in Chinese Patent Application No. 201580051261.9.

Jul. 30, 2019 Office Action issued in Chinese Patent Application No. 201580051261.9.

Shigley et al; "Standard Handbook of Mechanical Design;" College Mechanical of Hohai University, China Machine Press; pp. 7-10; Aug. 31, 1993.

* cited by examiner

APPLICATION DEVICE

TECHNICAL FIELD

The invention relates to an application device for multicomponent materials, in particular multicomponent adhesives or multicomponent sealants.

PRIOR ART

EP 1 072 323 A1 describes a cartridge discharge apparatus having a dynamic mixer. According to design, the mixer drive shaft, upon the insertion of double cartridges having different cross-sectional ratios, is in each case automatically pivoted into a "correct" position. Specifically, a displacement is effected by a pivoting parallel to the longitudinal axes of a container, wherein the two end positions of a driver, corresponding to a center axis of the mixer, lie on a straight line connecting the container outlets. All in all, by virtue of EP 1 072 323 A1, an adaptation to various double cartridges can be made. However, this adaptation is perceived as complex.

DE 32 37 353 A1 describes a device for mixing dental compounds. In one embodiment, a motor drives an agitator via a power take-off shaft. The power take-off shaft is configured such that it can be telescoped by spring means, and is positively coupled with a head by plug-in connection. The spring is enclosed by a housing. All in all, the device according to DE 32 37 353 A1 is less suited to an application device for multicomponent materials. In any event, the solution according to this prior art is regarded as open to improvement in terms of robustness and variability.

An application device for multicomponent materials is known, for instance, from EP 2 606 985 A1. There a drive unit which comprises a transmission unit is described. Via a rotating drive shaft, a rotary mixer is driven. The reliability and robustness of such an application device is regarded, however, as open to improvement. In particular, it has been shown that damage to the transmission can occasionally occur, which should preferably be prevented. In addition, the variability of the application device according to the prior art is regarded as open to improvement.

The object of the invention is to provide a reliable and robust rotary device in which, in particular, transmission damage can be avoided and which preferably can be variably adapted.

DISCLOSURE OF THE INVENTION

This object is achieved in particular by an application device having the features of claim 1.

In particular, the object is achieved by an application device for multicomponent materials, in particular multicomponent adhesives or multicomponent sealants, having at least two cartridge receiving devices for receiving exchangeable cartridges containing material components to be mixed, an expulsion device for expelling the material components from the cartridges, a mixing device which mixes the material components, wherein the mixing device comprises a rotary mixer which is driven via a drive shaft, said drive shaft comprising at least one flexible portion having a first end and a second end.

A central idea of the invention consists in proposing a flexible drive shaft. Flexible drive shafts are known in principle (though in completely different contexts).

By a flexible drive shaft should be understood, in general terms, a drive shaft which is flexible in terms of a bending load and/or a torsional load (thus yields up to a certain degree, without being destroyed). By virtue of a flexible drive shaft of this type, it is in particular possible to absorb short-term torque load peaks. Although short-term torque load peaks can (at least partially) also in principle be absorbed by a (hexagonal) spindle in interaction with a softer plastics piston, in practice such an absorption of shot-term torque load peaks has not always proved adequate. In particular, damage (for instance to the transmission) can result if the rotary mixer jams. Furthermore, a flexible drive shaft makes it possible to enable a variable positioning of the transmission for the drive. The transmission can thus be arranged offset. As a result, various application device variants, which have only slightly to be modified, are enabled, so that differently dimensioned cartridges or packs can be easily received, wherein only the position of the drive spindle has possibly to be adapted (by offset).

This presupposes, in particular, that the drive shaft is arranged such that it can to some extent be bent or twisted. In view of this, the drive shaft should thus be able to move freely up to a certain degree, so that at least two portions of the drive shaft can change in terms of their relative position (or relative rotation) to one another.

In the prior art, the structure of application devices having a rotary mixer is usually defined by the position of a mixer drive spindle. A position of the rotary mixer in the apparatus is thus defined by the arrangement of the transmission (or of a last pinion of the transmission)—apart from the longitudinal direction. If the transmission is structurally defined, however, the position of the rotary mixer can also no longer be altered. These restrictions are overcome by the invention in a simple manner, so that the variability of the application device is increased. While in the prior art an adaptation of the application device, for example to a larger cartridge ("B-cartridge"), is possible only by redesign of the transmission (or in some cases is impossible in dependence on the spatial conditions), according to the present invention a quick and easy adaptation can be made. As a result, a quick and easy reaction can be made to various requirements, such as different required mixing ratios, and thus cartridge sizes.

All in all, by means of the flexible drive shaft for the rotary mixer, the power take-off (for example the last pinion) of the transmission can be variably positioned and adapted to a variation of the transmission ratio. Due to the flexible drive shaft, the axial positioning of the transmission is comparatively variable. The omission of a transmission step or adaptations to a higher-speed motor are substantially easier to realize. In particular, the position of the (dynamic) rotary mixer can lie outside an axis which is defined by a piston assigned to a first material component and a piston assigned to a second material component. Correspondingly, the application device can be comparatively easily adapted to various mixing ratios or pack sizes (cartridge sizes).

The flexible portion is preferably rotationally elastic and/or flexurally elastic. By virtue of a rotationally elastic configuration, torque load peaks can be countered particularly effectively. Through the flexurally elastic configuration, the variability of the application device is easily increased.

The flexible portion can be configured such that a middle of the flexible portion is displaced (sags) by at least 10% of its length if its two ends are supported and a force of 10 N or less, preferably 5 N or less, further preferably 2 N or less, still further preferably 1 N or less, still further preferably 0.5 N or less is applied to the middle. In this perspective, the force should act in the radial direction. By a "displacement" is preferably understood a distance corresponding to a distance apart of an original position of the middle of the flexible portion (rest position) and the position at which the force is applied. In the rest position, the flexible portion is preferably straight. In the displaced (sagged) position, the portion is at least partially bent or kinked.

The first end of the flexible portion can rotate through at least 1°, preferably through at least 2°, further preferably through at least 4° in relation to the second end of the flexible portion if the second end is mounted in a rotationally secure manner and at the first end a torque of 1,000 Nm or less, preferably 500 Nm or less, further preferably 100 Nm or less, further preferably 50 Nm or less, still further preferably 20 Nm or less, still further preferably 5 Nm or less, still further preferably 1 Nm or less, still further preferably 0.5 Nm or less, is applied. Torque load peaks can thereby be effectively countered. Here too, the rotation is produced starting from a rest position (in which no torque is applied) and a rotation position (in which the torque is applied).

An elastic modulus of a material of the flexible portion can be ≤10 kN/mm$^2$, preferably ≤5 kN/mm$^2$, further preferably ≤1 kN/mm$^2$, still further preferably ≤0.5 kN/mm$^2$. Alternatively or additionally, a shear modulus of a material of the flexible portion can be≤5 kN/mm$^2$, preferably ≤1 kN/mm$^2$, still further preferably ≤0.5 kN/mm$^2$, still further preferably ≤0.1 kN/mm$^2$.

In principle, the flexible portion can be formed of just one material or a plurality of materials. If the flexible portion is formed of a plurality of materials, the elastic modulus or the shear modulus lies, preferably for at least one material, below the above-stated values, further preferably for all materials. In any event, it is advantageous if at least one material (or all materials) has an elastic modulus or shear modulus which lies clearly below that of steel, which is usually used for drive shafts. In relation to the prior art, a markedly improved robustness or variability of the application device is thereby achieved.

The shaft (or the flexible portion) is preferably configured, at least in some sections, as a (helical) spring. Alternatively or additionally, the shaft (or the flexible portion) can have a plurality of mutually distinct segments. The segments can be tilted (tiltable) relative to one another and/or can be rotated (rotatable) in relation to a respectively adjacent segment. In one specific embodiment, the shaft (or the flexible portion) can have at least one, preferably at least two, cardan joints (preferably a double cardan joint). All in all, the flexibility, in particular variability, of the application device is improved by such measures.

The drive shaft can be formed (at least in some sections) of plastic. Particularly preferably, the shaft has (at least in some sections) a plastics sheath, which further preferably encases, at least in some sections, the (helical) spring. In particular as a result of the one (helical) spring, which is encased by a plastics sheath an, in design terms, simple and effective and yet effective flexible drive shaft is realized.

The flexible portion can be at least 1 cm, preferably at least 3 cm, still further preferably at least 5 cm, still further preferably at least 8 cm, still further preferably at least 10 cm long. The flexible portion can be at most 20 cm, preferably at most 15 cm, still further preferably at most 10 cm long.

The shaft can, at least in some sections, be curved or curvable. A (minimum) radius of curvature can measure cm or less, preferably 15 cm or less, further preferably 10 cm or less, still further preferably 5 cm or less. By a (minimum) radius of curvature should be understood such a radius of curvature up to which the drive shaft can be at least curved without material damage arising and/or without the drive of the rotary mixer via the transmission being no longer possible. In the prior art, the rigid shafts are not curvable, in particular not so curvable that the application device would to some extent still function (in which case, it would thus no longer be an application device).

The shaft can, at least in some sections, be twisted and/or be twistable. A (maximum) torsion angle can measure at least 0.5°, preferably at least 1°, further preferably at least 2°, still further preferably at least 4°, still further preferably at least 10°. In addition, the (maximum) torsion angle can measure at most 20°, preferably at most 10°, still further preferably at most 5°. By a "maximum" torsion angle should be understood such a torsion angle up to which the drive shaft can (at least) be twisted without the drive shaft being destroyed, or up to which the application device (at least) still functions.

The drive shaft can be kinked and/or kinkable (at least once). An angle defined by the kink can measure 5° or more, preferably 10° or more, still further preferably 20° or more. Alternatively or additionally, an angle defined by the kink can measure 45° or less. By a "maximum" angle should be understood such an angle up to which the shaft, starting from a (kink-free) configuration (position), can be kinked without destroying the shaft.

The drive shaft can have at least a second portion, which runs offset (and/or can be offset) from a first portion, in particular by at least half a diameter of the shaft. By an "offsetting" should in particular be understood that at least one cross section of the second portion, in a projection onto a plane standing perpendicular to the longitudinal direction of the first portion, is offset from at least one cross section of the first portion.

A flexural strength of the flexible portion (in particular in the middle of the flexible portion) can be ≤50,000 Nmm$^2$, further preferably 5,000 Nmm$^2$, further preferably ≤1,000 Nmm$^2$, further preferably ≤500 Nmm$^2$. A torsional rigidity (in particular in the middle) of the flexible portion can be ≤40,000 Nmm$^2$, preferably 4,000 Nmm$^2$, still further preferably ≤800 Nmm$^2$, still further preferably ≤400 Nmm$^2$, still further preferably ≤100 Nmm$^2$.

The drive shaft can have at least one rigid portion. This rigid portion preferably (directly) adjoins the mixing device. Furthermore, the flexible portion can directly adjoin the rigid portion and/or the transmission. All in all, in this embodiment the rotary mixer can be driven effectively, while a comparatively high variability and robustness can nevertheless be realized.

The object is additionally achieved by an application system comprising an application device of the type described above and at least one first cartridge and/or second cartridge, wherein the first cartridge is preferably configured as a tubular bag and/or the second cartridge is preferably configured as a rigid, self-supporting cartridge.

In addition, the object is achieved by a set consisting of an application device of the type described above and at least two first cartridges and/or at least two second cartridges, wherein the at least two first cartridges and/or the at least two second cartridges are different in terms of their size, in particular their length and/or their diameter, wherein the differences can preferably be compensated by an adapted path of the drive shaft.

The at least two first cartridges within the set are configured and provided to introduce a first material component through the same first mixer inlet. The at least two second cartridges are provided and configured to introduce at least a second material component through the same second mixer inlet. A larger first (second) cartridge can have a diameter which is at least 10%, preferably at least 30% greater than the diameter of a smaller first (second) cartridge. A length of a larger first (second) cartridge can be at least 10% or at least 30% longer than a length of a smaller first (second) cartridge.

All in all, the flexible (in particular rotationally elastic) drive shaft makes it possible to absorb larger torques. Thus if the rotary mixer jams (which can often make itself heard by a "rattling" of a ground-down hexagon), damaging of components, in particular the transmission, can be avoided.

DESCRIPTION OF THE DRAWINGS

Advantages and expediency of the invention become clear from the following description of a preferred illustrative embodiment on the basis of the figures, wherein:

FIG. 1 shows a schematic representation of an application device for multicomponent materials, in particular multicomponent adhesives or multicomponent sealants. The application device has a metering and mixing device 10, a drive device 11 and an apparatus body 12. The metering and mixing device 10 comprises two cartridge receiving devices 13 and 14 for respectively receiving cartridges 15 and 16. The cartridge(s) 15 is preferably configured as a tubular bag, the cartridge(s) 16 as a fixed (self-supporting) cartridge(s). In terms of the discharge and mixing of the material components contained in the cartridges 15, 16, reference is made to EP 2 606 985 A1.

Figure 1:
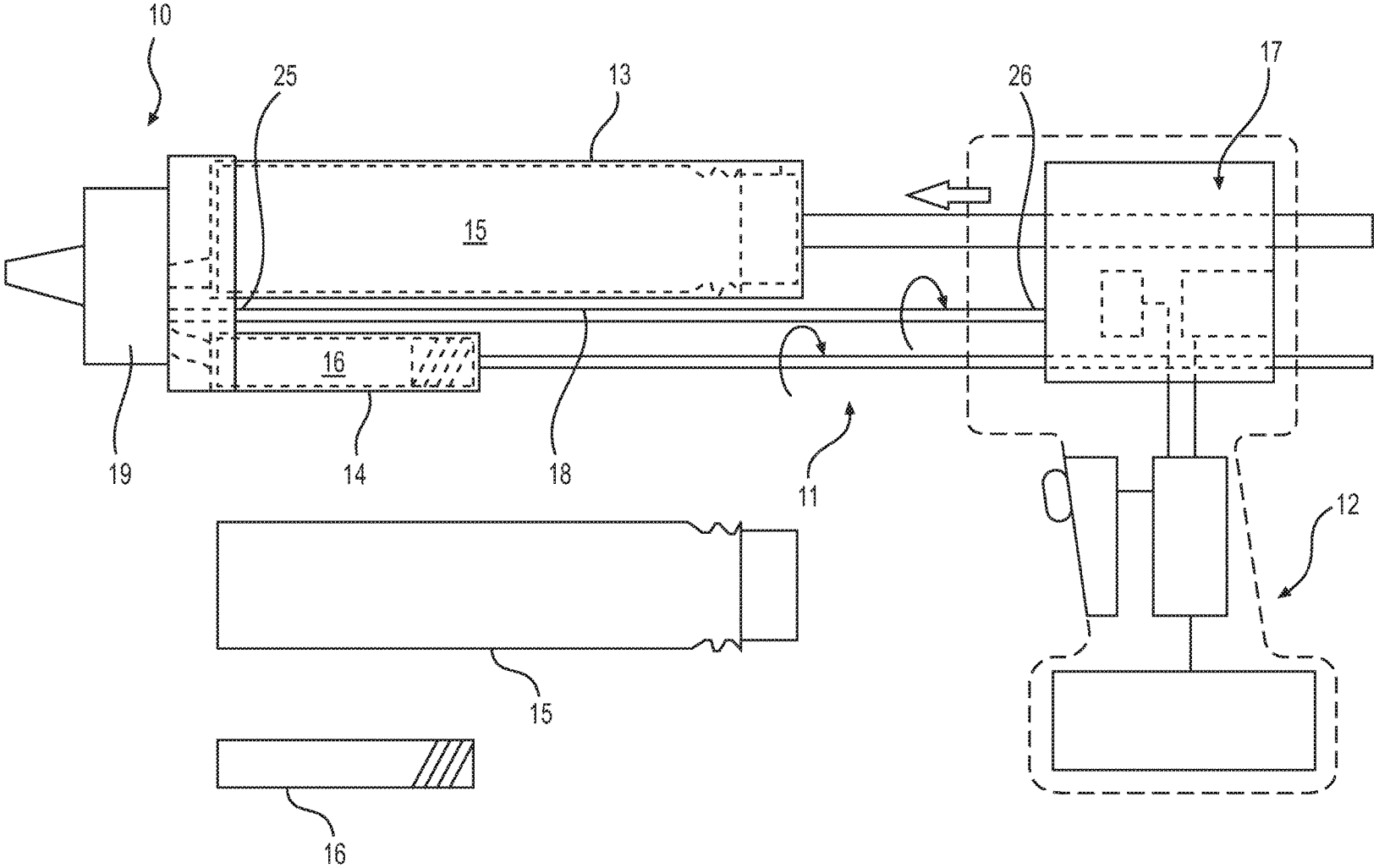
FIG. 1 shows a schematic structure of an application device.

The drive device 11 comprises a transmission 17, which, on the one hand (as described in detail in EP 2 606 985 A1) can bring about an expulsion of the material components from the cartridges 15, 16 and, on the other hand, is connected to a drive shaft 18. The drive shaft (unlike in the prior art, in particular EP 2 606 985 A1) is not of rigid, but of flexible configuration. Via the flexible drive shaft 18, a rotary mixer 19 of the metering and mixing device 10 can be driven. The rotary mixer 19 possesses a front-fitted expulsion tip 20.

In principle, all elements (apart from the flexible drive shaft 18) can be configured as described in EP 2 606 985 A1. This concerns, in particular, the drive of the transmission unit, for example via an electric motor, or details of the transmission.

Figure 2:
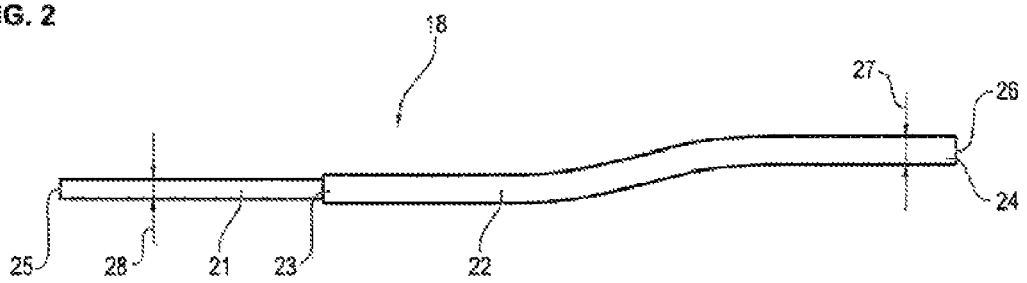
FIG. 2 shows a drive shaft according to the invention.

In FIG. 2, the flexible drive shaft 18 is represented schematically (and with further details). The flexible drive shaft 18 has a rigid portion 21 and a flexible portion 22 having a first end 23 and a second end 24. At variance with FIG. 2, more than just one rigid portion or more than just one flexible portion can also be provided. In general, the flexible portion can form the shaft, i.e. the entire shaft can be flexible (without rigid portion).

A first end 25 of the flexible shaft 18 is connected (see FIG. 1) to the rotary mixer 19. A second end 26 of the drive shaft 18 is connected to the transmission 17. The first end 25 is directly adjoined by the rigid portion 21. The second end 26 is directly adjoined by the flexible portion 22.

The flexible portion 21 is rotationally elastic and flexurally elastic. As a result, both torque peaks can be absorbed and a variable adaptation to different cartridges or mixer positions can be made. In the position of the flexible portion 22 according to FIG. 2, a cross section, bearing the reference symbol 27, is arranged offset from a cross section 28 of the rigid portion 21. If the cross section 27 is thus projected onto a plane perpendicular to the axis defined by the rigid portion 21, then the cross section 27 is offset from the cross section 28. In a rest position or starting position (not shown in FIG. 2), the flexible portion 22 too can run straight. All in all, by a displacement (bending) of the flexible portion 22, an adaptation to various relative positions between rotary mixer 19 and transmission 17 and/or an adaptation to various cartridge sizes can be made.

The flexible portion 22 can be formed by a (metallic) helical spring core, which is surrounded by a plastics sheath.

REFERENCE SYMBOL LIST

10 metering and mixing device
11 drive device
12 apparatus body
13 cartridge receiving device
14 cartridge receiving device
15 cartridge
16 cartridge
17 transmission
18 flexible drive shaft
19 rotary mixer
20 expulsion tip
21 rigid portion
22 flexible portion
23 first end
24 second end
25 first end
26 second end
27 cross section
28 cross section

The invention claimed is:

1. An application device for multicomponent materials, including multicomponent adhesives or multicomponent sealants, comprising:

at least two cartridge receiving devices for receiving exchangeable cartridges containing material components to be mixed;

an expulsion device for expelling the material components from the cartridges; and a mixing device for mixing the material components, wherein the mixing device includes a rotary mixer which is configured to be driven via a drive shaft said drive shaft having at least one flexible portion having a first end and a second end, wherein the drive shaft is, at least in some sections, twisted and/or is twistable, and a (maximum) torsion angle measures at least 1°.

2. The application device as claimed in claim 1, wherein the flexible portion is rotationally elastic and/or flexurally elastic.

3. The application device as claimed in claim 1, wherein a middle of the flexible portion is displaced by at least 10% of a length of the flexible portion when the first and second ends of the elastic portion are supported and a force of 10 N or less is applied to the middle; and/or wherein the first end of the flexible portion rotates through at least 2° in relation to the second end of the flexible portion when the second end is mounted in a rotationally secure manner and at the first end a torque of 100 Nm or less is applied.

4. The application device as claimed in claim 1, wherein an elastic modulus of a material of the flexible portion is ≤10 $kN/mm^2$ and/or a shear modulus of a material of the flexible portion is ≤5 $kN/mm^2$.

5. The application device as claimed in claim 1, wherein the drive shaft is configured, at least in some sections, as a spring and/or is divided into a plurality of mutually distinct, and/or mutually rotatable segments, wherein the drive shaft has at least one cardan joint.

6. The application device as claimed in claim 1, wherein the drive shaft is formed, at least in some sections, of plastic, and has in some sections a plastics sheath, which is a helical spring.

7. The application device as claimed in claim 1, wherein the flexible portion is at least 3 cm.

8. The application device as claimed in claim 1, wherein the drive shaft is, at least in some sections, curved or curvable, wherein a (minimum) radius of curvature measures 20 cm or less.

9. The application device as claimed in claim 1, wherein the drive shaft is kinked and/or is kinkable, wherein a (maximum) angle defined by the kink measures 5° or more and/or 45° or less.

10. The application device as claimed in claim 1, wherein the drive shaft has at least a second portion, which runs offset from a first portion, by at least half a diameter of the shaft.

11. The application device as claimed in claim 1, wherein a flexural rigidity in a middle of the flexible portion is ≤50,000 $Nmm^2$ and/or a torsional rigidity in the middle of the flexible portion is ≤40,000 $Nmm^2$.

12. The application device as claimed in claim 1, wherein the drive shaft has at least one rigid portion, wherein the rigid portion adjoins the mixing device.

13. An application system comprising:

an application device for multicomponent materials, including multicomponent adhesives or multicomponent sealants, having:

at least two cartridge receiving devices for receiving exchangeable cartridges containing material components to be mixed;

an expulsion device for expelling the material components from the cartridges; and a mixing device for mixing the material components, wherein the mixing device includes a rotary mixer which is configured to be driven via a drive shaft, said drive shaft having at least one flexible portion having a first end and a second end; and comprising:

at least one first cartridge and/or second cartridge, wherein the first cartridge is configured as a tubular bag and/or the second cartridge is configured as a rigid, self-supporting, cartridge, wherein the drive shaft is, at least in some sections, twisted and/or is twistable, and a (maximum) torsion angle measures at least 1°.

14. A set consisting of an application device having for multicomponent materials, including multicomponent adhesives or multicomponent sealants, comprising:

at least two cartridge receiving devices for receiving exchangeable cartridges containing material components to be mixed;

an expulsion device for expelling the material components from the cartridges;

a mixing device for mixing the material components, wherein the mixing device includes a rotary mixer which is configured to be driven via a drive shaft, said drive shaft having at least one flexible portion having a first end and a second end; and at least two first cartridges and/or at least two second cartridges, wherein the at least two first cartridges and/or the at least two second cartridges are different in terms of size, length, or diameter, wherein the differences are compensated by an adapted path of the drive shaft.

15. The application device as claimed in claim 1, wherein a middle of the flexible portion is displaced by at least 10% of a length of the flexible portion when the first and second ends of the elastic portion are supported and a force of 1 N or less is applied to the middle; and/or wherein the first end of the flexible portion rotates through at least 2° in relation to the second end of the flexible portion when the second end is mounted in a rotationally secure manner and at the first end a torque of 5 Nm or less is applied.

16. The application device as claimed in claim 1, wherein an elastic modulus of a material of the flexible portion is ≤1 $kN/mm^2$ and/or a shear modulus of a material of the flexible portion is ≤0.5 $kN/mm^2$.

17. The application device as claimed in claim 1, wherein the drive shaft is configured, at least in some sections, as a helical spring and/or is divided into a plurality of mutually distinct, and/or mutually rotatable segments, wherein the drive shaft has two cardan joints.

18. The application device as claimed in claim 1, wherein the flexible portion is at least 8 cm.

19. The application device as claimed in claim 1, wherein the drive shaft is, at least in some sections, curved or curvable, wherein a (minimum) radius of curvature measures 10 cm or less.

* * * * *